United States Patent [19]

Ashworth et al.

[11] 4,040,431

[45] Aug. 9, 1977

[54] METHOD OF INCREASING THE FILLING CAPACITY OF SHREDDED TOBACCO TISSUE

[75] Inventors: James G. Ashworth; Eugene Glock; James G. Kelly, all of Richmond; James L. McLaughlin, Chester; Owen T. Merwin, Richmond, all of Va.

[73] Assignee: American Brands, Inc., New York, N.Y.

[21] Appl. No.: 610,736

[22] Filed: Sept. 5, 1975

[51] Int. Cl.[2] ..... A24B 3/18

[52] U.S. Cl. ..... 131/140 P

[58] Field of Search ..... 131/140 C, 140 P, 2, 131/17 R

[56] References Cited

U.S. PATENT DOCUMENTS 3,734,104 5/1973 Buchanan ..... 131/140 P

*Primary Examiner*—Robert W. Michell
*Assistant Examiner*—V. Millin
*Attorney, Agent, or Firm*—Pennie & Edmonds

[57] ABSTRACT

The filling capacity of shredded tobacco tissue is increased by being first conditioned by treating the tobacco to raise its temperature to at least about 130° F. and its moisture content above about 15% and then hot-gas drying the tobacco in the form of a thin laminar dispersion, about 1 inch thick, in the gas at a temperature such that the moisture content of the tobacco will be lowered within about 5 seconds to the optimum moisture content to maintain improved filling capacity in the tobacco end products made from such material.

6 Claims, No Drawings

METHOD OF INCREASING THE FILLING CAPACITY OF SHREDDED TOBACCO TISSUE

BACKGROUND OF THE INVENTION

There are presently a variety of procedures utilized for increasing the filling capacity of shredded tobacco tissue including contacting tobacco leaves and/or stems and/or veins with moisture (in the form of water and/or steam) or a solvent and then exposing the thus treated tobacco to heat, a vacuum or freeze-drying so as to cause the tobacco to have an increased filling capacity.

None of the heretofore known procedures has, however, been entirely satisfactory for a variety of reasons. For example, water treatment followed by freeze-drying results in a product which has an objectionable amount of tackiness because of the hygroscopicity of a film-like layer of water-extracted solids which forms on the surface of the tobacco. In many of the heat expansion processes, while there is an initial expansion, the expansion disappears upon drying. The use of solvent expansion has not been entirely suitable since it adds non-tobacco elements to the tobacco.

Most importantly, these prior techniques are not satisfactory in treating a blend of tobaccos to be formed into a final product since they puff the tobacco to such a large extent that it is not possible to form it using the usual apparatus and techniques into stable non-collapsible final products, such as cigarettes. In addition, the prior procedures cannot be used since the cost of the materials and equipment needed is prohibitive. As a consequence, present practice requires that tobacco that has been treated to increase its filling capacity, as by being expanded, must be blended with non-treated tobacco. This is undesirable, particularly since it requires an extra blending step and the maintenance of separate storage facilities for the treated and untreated tobacco.

SUMMARY OF THE INVENTION

A process has not been devised in which shredded tobacco, including total blends, can be treated to increase its filling capacity, which treated blend of tobacco can be formed into stable end products, such as cigarettes, using standard end product forming methods and apparatus.

Briefly stated, the present invention comprises the steps of conditioning a total blend of tobacco shreds to be used to form an end product by treating such tobacco shreds to raise the temperature thereof to at least about 130° F. and the moisture content to at least about 15% and maintaining the tobacco shreds to such a temperature and moisture content for a time sufficient to permit the cut tobacco to at least open from the compressed form resulting from cutting and promptly drying the thus conditioned tobacco in the form of a thin dispersion with a hot gas at a temperature such that its moisture content will be lowered to its optimum making moisture content within about 5 seconds.

DETAILED DESCRIPTION

The instant invention, while applicable to all tobacco-tissue and byproducts, including strips, stems, and veins, is particularly adapted to increasing the filling capacity of shredded tobacco to be used in making cigarettes. More particularly, it is adapted to increasing the filling capacity of a blend of different tobaccos and tobacco materials used to make cigarettes, cigars, or other tobacco products formed from shredded tobacco materials. This blend of tobaccos is hereinfater referred to as the "total blend".

It will be recognized that a variety of differnt types and proportions of tobacco (flue cured, air cured, oriental, etc.) and tobacco materials (strip, stem, veins, byproducts, etc.) can be and are used in forming the total blend dependent upon the flavor and other characteristics desired in the end product. The instant invention is suitable for all such varieties and types of tobacco and tobacco materials used and proportions used. For purposes of describing the invention, however, it will be described in connection with total blends. The total blends can be formed by any conventional procedure, as by admixing the various components and shredding them in a cutter, such as a standard Molins or Legg cutter.

The initial and an essential step of the instant process is the conditioning of the total blend prior to flash drying. This conditioning is important in order to permit what can be best characterized as an opening of the shredded tobacco to its more open, irregularly shaped form as opposed to the compressed form that results from the cutting or shredding operation. It has been found that this can be accomplished by treating the tobacco to raise its temperature to at least about 130° F. and its moisture content to at least about 15%. It will be evident that, dependent upon the temperature used and the degree of moisture to which the tobacco is exposed, that the preconditioning time necessary to effect such opening can vary widely. However, it will be understood that the maximum temperature used is below that at which the tobacco will become scorched or discolored, or have an adverse effect on aroma or subsequent smoke taste. An upper limit is 250° F. with temperatures in the range of 180° to 200° F. being preferred. The upper moisture level is preferably about 35% with a range of 22 to 26% preferred. Operating within these parameters, the time necessary to condition the tobacco can vary from a period of seconds to about 5 minutes.

The particular time and conditions will also vary dependent upon the type of tobacco in the blend, moisture content, and the tobacco and cutting conditions (temperature, pressure, moisture). The most optimum conditions can be readily determined by exposing a particular total blend to heat and moisture treatment within the ranges noted and then observing the temperature and moisture levels which are most effective in giving the desired increase in filling capacity. This conditioning of the tobacco can be carried out in any suitable apparatus into which the tobacco can be fed, preferably continuously, and in which the temperature and moisture content can be controlled such as a heating, metering, and ordering chamber, such as a chute or drum.

After such conditioning, the total blend is promptly dried in the form of a substantially continuous thin laminar flow in a hot gas. Preferably, the thickness of the laminar dispersion should be about 1 inch. It is essential that this drying be accomplished with a hot gas, preferably hot, moist air, in the shortest possible time. Contributing to the rapid drying is the step of disrupting the laminar flow toward the end of the drying stage to form a highly turbulent flow before the tobacco is separated from the drying gas. This contributes to the rapid evaporation of the moisture from the tobacco. For drying, the gas temperature should be from about 300° to 600° F. and the moisture level of the tobacco lowered to that approaching its normal making moisture content.

For most tobacco blends used in forming cigarettes, such moisture level is about 11% to 16% It is necessary to accomplish such drying in the period of less than about 5 seconds and preferably less than about 2 seconds.

Such drying can be effected in a flash dryer, preferably one in which the tobacco blend dispersion can be passed through as a continuous laminar stream or sheet-like configuration. A particularly effective dryer is set forth in copending application Ser. No. 610,740, in the name of James G. Kelly, filed on even date herewith. The drying can be carried out in a vacuum or atmospheric or elevated pressure.

The tobacco is then cooled by any suitable means, as by a current of ambient air, and the tobacco may then be appropriately flavored and the expanded total blend used to form cigarettes or the treated blend may itself be blended with non-treated tobacco to form cigarettes, and the like. Of importance is the fact that this treated tobacco retains its increase in filling capacity which can vary from about 5 to 25% greater than untreated tobacco product with no more than the usual loss of filling power during the handling required in cigarette manufacture.

While the precise theory for this controlled increase in filling capacity is not completely understood, it is believed that during the conditioning some delamination and opening of the shredded tobacco occurs along with some possible swelling of the shreds. The elevation, moreover, of tobacco temperature to near the boiling point of water permits the water to be rapidly removed when the tobacco enters the drying step. This high temperature treatment coupled with short treatment time is such to cause the water vapor pressure to elevate thus causing rapid water removal and in so doing exerts a positive internal pressure such that the expansive effect is greater during drying than for processes usually associated with conventional tobacco drying.

Thus, the dried tobacco with increased filling capacity, which results from expansion and opening, is stabilized in that state, resisting the closing back thereof.

The invention will be further describwed in connection with the following examples which are set forth for purposes of illustration only and in which all proportions are by weight unless expressly stated to the contrary.

EXAMPLE 1

2500 parts of a commercially sold filter menthol cigarette blend containing flue-cured, burley, oriental, and byproduct tobaccos in the form of tobacco strip and without finishing flavor or menthol were cut or shredded with Molins cutter. Moisture after cutting was 19.9%. The cut tobacco was conveyed through appropriate conveying system through a metering chute to a conditioning chute. Moisture and temperature of the tobacco was adjusted with steam so that the tobacco leaving the chute was at a moisture content of 22.4% and a temperature of 185° F. The conditioned tobacco was conveyed in an even thickness stream using motor driven doffers above an inclined conveyor to the entrance of a flash dryer 6 feet wide. The gas of this system as measured in the plenum was at a temperature of 400° F. and the air volume was at 7,300 scfm. The tobacco leaving the dropout of the dryer had a moisture of 13.4%. On further conveying and ambient drying, the tobacco moisture was 13.1% and the filling capacity and as used herein synonymously therewith "filling power" increase above a control shredded sample of tobacco processed in an ADT dryer was 18.5% (4.86 cc/gm filling power of treated sample for 4.10 cc/gm for an untreated sample). Tobacco was processed in this system at a rate of feed of approximately 5500 pounds per hours using a hot, moist gas recycle ratio of 56%. The tobacco was conveyed through a flavoring drum for application of finishing flavor and menthol. The filling power increase after this additional step showed an increase above the control of 15.1% (4.71 cc/gm treated versus 4.10 cc/gm control).

Cigarettes manufactured from the treated experimental tobacco were made at weights of 109.5 cigarettes per four ounces and these compared favorably with control cigarettes made with conventionally processed tobacco at heavier weights of 107.5 cigarettes per four ounces as far as physical properties and smoke composition. Thus, eight cigarettes more per pound of tobacco could be manufactured using tobacco treated in accordance with the present invention.

EXAMPLE 2

300 parts of a commercially sold non-filter blend containing a mixture of flue-cured, burley, oriental and byproduct tobacco shredded in the factory, but without finishing flavor and at a moisture of 17.9% was conveyed to a heating and ordering chute. The tobacco was treated in the conditioning chute so as to raise the temperature to 190° F. and the moisture to 22.3%. Tobacco was conveyed in an even layer to a 3-foot wide "U" shaped flash dryer and expanded and dried with a hot air mixture at a temperature of 350° F. as measured at the plenum. The air volume was 3600 scfm using a hot, moist gas recycle ratio of 60% return. The tobacco came out the dryer rotary lock dropout at at 16.4% moisture and, after passing over a vibrational cooler-shaker conveyor, had a moisture of 15.2%. Tobacco was finally conveyed to storage containers where it had a moisture of 15.1%. The filling power increase as determined on regular analysis of the sample drawn from the storage container was 7.9% (filling power of 4.10 cc/gm treated versus 3.80 cc/gm for control reference blend processed in the conventional manner). The rate of tobacco treatment through the dryer was 2750 pounds per hour.

EXAMPLE 3

The experiment of Example 2 was repeated, except that a drying temperature of 400° F. was used. Moisture of the tobacco after the heating and ordering chute was 23.5%, out the dryer at the rotary lock dropout moisture was 16.5%, after the vibrational cooler-shaker moisture was 14.7%, and finally at the storage container moisture was determined at 14.2%. The filling power increase as determined on a sample of tobacco taken from the storage container was 10.5% (filling power of 4.20 cc/gm treated versus 3.80 cc/gm for control processed in the conventional manner).

EXAMPLE 4

600 parts of a commercially sold filter blend containing flue-cured, burley, oriental, and byproduct tobaccos shredded or cut in the factory, but without finishing flavor, at a moisture of 18.2% was conveyed to the heating and ordering chute. Tobacco was treated in the conditioning chute so as to raise the temperature to 204° F. to a moisture content of 24.1%. Tobacco was conveyed in an even layer to a 3-foot wide "U" shaped flash dryer and expanded and dried with a hot air mixture at a temperature of 400° F. as measured at the plenum. The air volume was 3600 scfm using a hot, moist gas recycle ratio of 60% return. The tobacco exited at the dryer rotary lock 14.7% moisture and after passing over a vibrational cooler-shaker conveyor, had a moisture content of 15.6%. Tobacco was finally conveyed to storage containers where it had a moisture of 13.3%. The filling power increase as determined on regular analysis of the samples drawn from the storage containers was 18.7% (filling power of 4.51 cc/gm treated versus 3.80 cc/gm for control reference blend processed in the conventional manner). The rate of tobacco treatment through the dryer was 2700 pounds per hour.

The filling power was measured in all the foregoing Examples using a 50 mm diameter open-top cyclinder into which a 20 gram sample of the tobacco is placed after being equilibrated at 60% R.H. and 80° F. for 5 days. A piston exerting a force of 1.5 psi pressure is applied to the sample for 3 minutes and, after the force is released, the height of the sample in the cylinder is measured and the filling capacity reported as cc/gram.

By way of illustrating the importance of the relationship between the temperature of the tobacco entering the drying zone and the temperature of the hot gas, the following table shows the water vapor pressure differential between the water in the tobacco and that in the drying air; the drying air having a dry bulb temperature of 400° F., wet bulb 132° F., dew point 97° F., and a water vapor pressure of .867 psia.

| Tobacco Temp. | Vapor Pressure of Water in Tobacco | Vapor Pressure Differential |
|---|---|---|
| 140° F. | 2.89 psia | 2.02 psia |
| 180° F. | 7.51 psia | 6.64 psia |
| 185° F. | 8.3 psia | 7.51 psia |

It will be appreciated that the greater the vapor pressure differential, the more rapid and effective the water removal from the tobacco.

While the invention has been described in connection with a preferred embodiment, it is not intended to limit the invention to the particular form set forth, but, on the contrary, it is intended to cover suc alternatives, modifications and equivalents as may be included within the spirit and scope of the invention as defined by the appended claims.

What is claimed is:

1. The process of increasing the filling capacity of shredded tobacco comprising the steps of first conditioning the tobacco so that its temperature is at least about 130° F. to 250° F. and its moisture content from about 15% to 35% promptly followed by drying the thus conditioned tobacco with a hot gas while the tobacco is in the form of a substantially thin laminar dispersion in the gas at a temperature such that the moisture content of the tobacco will be lowered within about 5 seconds to a moisture content of about 11% to 16%.

2. The process of claim 1 wherein the conditioning temperature is about 190° F. and the moisture content above about 20%.

3. The process of claim 1 wherein the drying temperature is from about 300° to 600° F.

4. The process of claim 3 wherein the hot, gas drying time is no more than about 2 seconds.

5. The process of increasing the filling capacity of shredded total blend tobacco comprising the steps of first conditioning the blend by raising its temperature to about 180° F to 200° F. and its moisture content to above about 22 to 26% promptly followed by drying the thus conditioned tobacco at a temperature of 300° F to 600° F. to a moisture content of about 11 to 16% in a period of less than 5 seconds with a hot gas while the blend is in the form of a substantially thin laminar dispersion about 1 inch thick in the gas.

6. The process of claim 5 including the step of disrupting the laminar flow near the end of the drying to form a highly turbulent flow prior to separating the tobacco from the drying gas.

* * * * *